US007726896B2

(12) United States Patent
Bolton

(10) Patent No.: US 7,726,896 B2
(45) Date of Patent: Jun. 1, 2010

(54) COLOURING APPARATUS

(75) Inventor: Terence William Bolton, Handcross (GB)

(73) Assignee: LaJa Materials Limited

( * ) Notice: Subject to any disclaimer, the term of this patent is extended or adjusted under 35 U.S.C. 154(b) by 759 days.

(21) Appl. No.: 10/592,369

(22) PCT Filed: May 11, 2005

(86) PCT No.: PCT/GB2005/001817

§ 371 (c)(1),
(2), (4) Date: Jan. 29, 2007

(87) PCT Pub. No.: WO2005/108112

PCT Pub. Date: Nov. 17, 2005

(65) Prior Publication Data

US 2008/0038047 A1 Feb. 14, 2008

(30) Foreign Application Priority Data

May 11, 2004 (GB) ..... 0410373.5
Sep. 6, 2004 (GB) ..... 0419654.9

(51) Int. Cl.
*B43K 29/00* (2006.01)

(52) U.S. Cl. ..... 401/195; 401/34; 401/198

(58) Field of Classification Search ..... 401/34, 401/195, 198, 199, 202
See application file for complete search history.

(56) References Cited

U.S. PATENT DOCUMENTS

| | | | | |
|---|---|---|---|---|
| 3,195,169 | A * | 7/1965 | Chadbourn | 401/119 |
| 4,614,163 | A * | 9/1986 | Hetzer et al. | 118/268 |
| 5,626,431 | A * | 5/1997 | Hetzer et al. | 401/119 |
| 7,004,660 | B2 * | 2/2006 | Kaempf | 401/202 |
| 7,470,079 | B2 * | 12/2008 | Bedhome et al. | 401/199 |

FOREIGN PATENT DOCUMENTS

| | | |
|---|---|---|
| DE | 89 01 093 | 3/1989 |
| DE | 40 39 614 | 6/1992 |
| DE | 93 06 282 | 7/1993 |
| DE | 94 01 654 | 4/1994 |
| DE | 44 10 919 | 10/1995 |

OTHER PUBLICATIONS

International Preliminary Examination Report, Nov. 23, 2006.
International Search Report, Aug. 25, 2005.

* cited by examiner

*Primary Examiner*—David J Walczak
(74) *Attorney, Agent, or Firm*—Michael D. Eisenberg

(57) ABSTRACT

An apparatus for enabling a liquid or dye to be conveyed from a nib of a source of liquid or dye to a fluid absorbent nib of a marker pen. The apparatus includes a tubular docking member having the source and the nib of the source at a first end and an open portion at a second end configured to receive and engage an end of the marker pen including the nib of the marker pen, the length of the docking member being such as to enable the nib of the marker pen selectively to be placed in contact with the nib of the source to cause liquid or dye to pass between the nib of the source and the nib of the marker pen. The liquid may comprise a translucent liquid such as water and the dye may comprise an indicator such as a water-based ink containing colored dyes, dispersed pigments or other coloring media.

11 Claims, 5 Drawing Sheets

COLOURING APPARATUS

This invention relates to colouring apparatus. More especially, the invention relates to marker pens.

Typically marker pens comprise a tubular housing having a fibrous felt-like nib connected via a liquid absorbent wick to an internal chamber containing a fluid indicator such as a water-based ink which contains a coloured dye (hereinafter referred to as a dye or coloured dye for ease of understanding). As the marker pen is used the fibrous nib is replenished with ink which travels through the wick from the chamber by capillary action to the nib. Such pens are well known and are used inter alia to mark text and produce coloured effects on paper or similar materials.

Generally, a marker pen is dedicated to producing a single colour. If two or more colours are required, the same number of individual pens are normally required. Marker pens having more than one nib have been proposed, the intention of these being to produce two or more side-by-side coloured lines with one stroke of a pen or a single line of a selected colour. Such a marker pen is disclosed in WO 94/0997, WO 01/15912, U.S. Pat. Nos. 5,203,638, 3,887,287, UK-A-2277253. Marker pens are also known in which a finer nib can overlie a larger nib to enable a single pen to produce lines of different widths. Such pens are disclosed in EP-A-630326, U.S. Pat. Nos. 5,813,787 and 5,651,627. The Applicant's earlier application, PCT/GB2004/000859 discloses a marker pen having a casing including a fluid absorbent nib containing a liquid or dye of a first colour, the interior of the casing being adapted to receive at least a portion of a reservoir pen having a fluid absorbent nib containing a liquid or dye of a second colour which, when the reservoir pen is inserted into the open end of the casing, makes contact with the marker nib to allow donation of the second colour to produce a colour change in a single line or succession of such lines using the same marker pen.

One object of the present invention is to provide alternative apparatus capable of enabling a marker pen consistently to produce in a line or succession of lines a uniform and consistent colour change from a first color from a source to a second color from the marker pen.

According to a first aspect, there is provided apparatus for enabling a liquid or dye to be conveyed from a source to a nib of a marker pen, the device comprising a docking member having an opening which is shaped and dimensioned to receive and engage with an end portion of a marker pen including the pen nib and to place the tip of the pen nib in contact with the source thereby enabling liquid or dye to flow from the source to the nib.

The liquid may comprise a translucent liquid such as water and the dye may comprise an indicator such as a water-based ink containing coloured dyes, dispersed pigments or other colouring media. Alternatively, the coloured dye may be oil-based.

In one arrangement, the source comprises another marker pen. In this arrangement, the docking member may comprise an open-ended hollow elongate tubular member with each open end shaped and dimensioned to fit over a collar of a marker pen.

In a second aspect, there is provided apparatus for conveying a liquid or dye from one marker pen to another, the apparatus comprising a tubular docking member having one end shaped and dimensioned to engage with an end portion of a first marker pen including the pen nib and the other end shaped and dimensioned to engage with an end portion including a nib of a second marker pen, the docking member being of such length that, when the end portions of the first and second member pens are engaged within the respective ends of the docking member the marker pen nibs make tip to tip contact, thereby enabling liquid or dye to pass therebetween.

In a third aspect, the invention provides colouring apparatus comprising a first marker pen having a housing including an absorbent nib containing a liquid or dye of a first colour, and a second marker pen having a housing including an absorbent nib containing a liquid or dye of a second colour, the housings of first and second marker pens being dimensioned and shaped to engage opposing end portions of a tubular docking member such that, in use, the absorbent nibs of first and second marker pens make contact with one another within the docking member.

The marker pen nibs may be produced from a fibrous material such as felt. Alternatively, one or each nib may be produced from a relatively inflexible material; a preferred material is that marketed under the trade mark POREX. This is a porous fluid retaining substance which holds its shape when applied to a surface in the manner of a marker to paper, card or like material. Other materials having similar physical properties may, however, be used.

In another arrangement, the source comprises a quantity of fluid absorbent liquid or dye containing wadding present within a docking member having at least one recessed opening shaped and dimensioned to engage with an end portion of a marker pen including a fluid absorbent nib, the dimensions of the or each docking member being such that when a marker pen is engaged within an opening the tip of its nib makes contact with the absorbent wadding to enable liquid or dye to flow to the marker pen nib.

In this arrangement, the recessed opening may be positioned at one end of a generally tubular casing, the other end of the casing being closed to retain the fluid absorbent wadding within the casing.

The invention will now be described by way of example only with reference to the accompanying diagrammatic drawings, in which.

Figure 1:
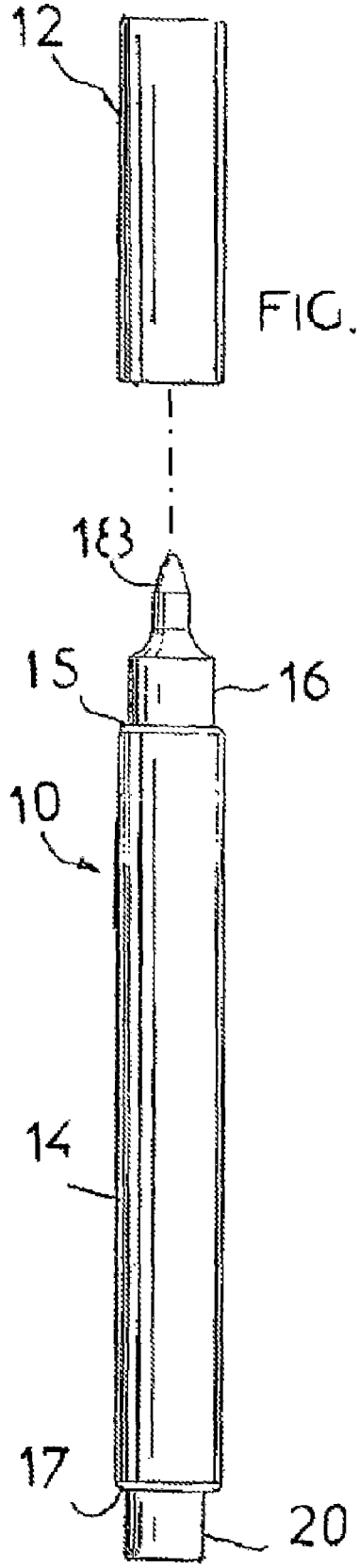
FIG. 1 is a side view of a marker pen and docking member constructed in accordance with a first embodiment of the invention.

FIG. 1 illustrates a marker pen 10 and an open ended tubular docking member 12 in accordance with the invention. The marker pen 10 comprises an elongate generally tubular housing 14 having a collar 16 from which protrudes a fibrous felt-like nib 18 connected via a liquid absorbent wick (not shown) to an internal chamber (not shown) containing a fluid indicator such as a water-based ink which contains a coloured dye (hereinafter referred to as a dye or coloured dye for ease of understanding). A further collar 20 extends from the end of the marker pen remote from the nib 18. The entire pen structure 10 is generally cylindrical. Both collars 16, 20 are of the same diameter, which is less than the diameter of the pen housing 14. This difference in diameter causes upstanding annular abutment surfaces 15, 17 to be provided between the housing 14 and the collars 16, 20 respectively.

A removable cap 19 is provided to seal the absorbent nib 18 when the pen is not in use.

The docking member 12 comprises an open ended tubular member dimensioned to complement the dimensions of the marker pen 10. Consequently, in the case of a generally cylindrical pen 10 as described above, the docking member 12 is also generally cylindrical. The internal diameter of the docking member 12 is slightly greater than the outer diameter of the collars 16, 20 to enable the docking member 12 to engage with and over either collar 16, 20 until the end of the docking member 12 makes contact with the respective abutment surface 15, 17.

Figure 2:
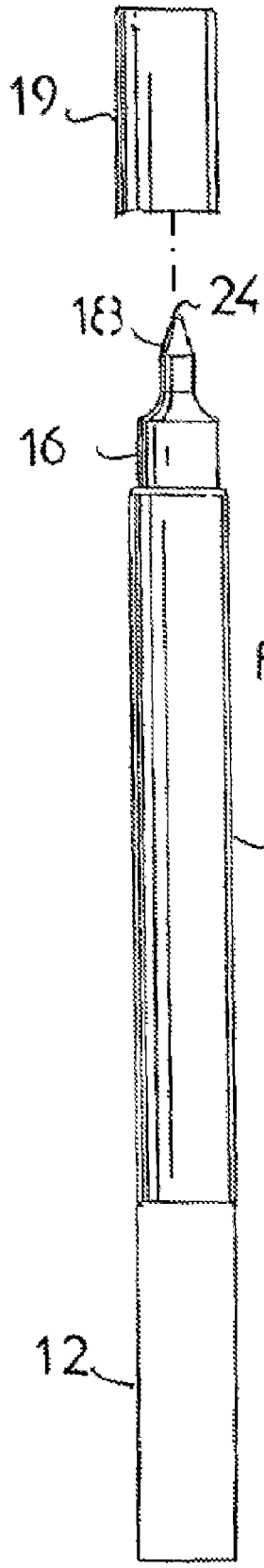
FIG. 2 is a side view of the marker pen and docking member of FIG. 1 in one use.

In the case of the docking member 12 engaging over the end collar 20, as shown in FIG. 2, the docking member 12 acts as an extension to the pen housing 14.

Figure 3:
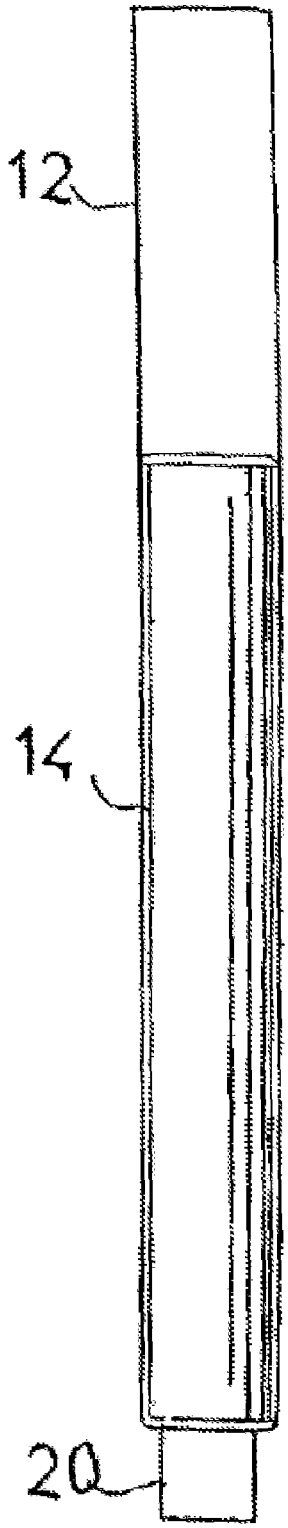
FIG. 3 is a side view of the marker pen and docking member of FIG. 1 in a second use.

In the case of the docking member 12 engaging over the other collar 16 adjacent to the nib 18, as shown in FIG. 3, the docking member 12 acts as a cover to protect the nib 18.

Figure 4:
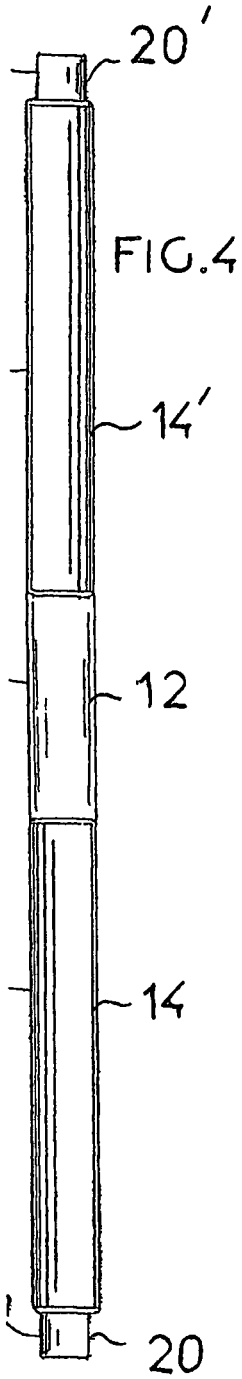
FIG. 4 is a side view of two marker pens combined with a docking member.
Figure 5:
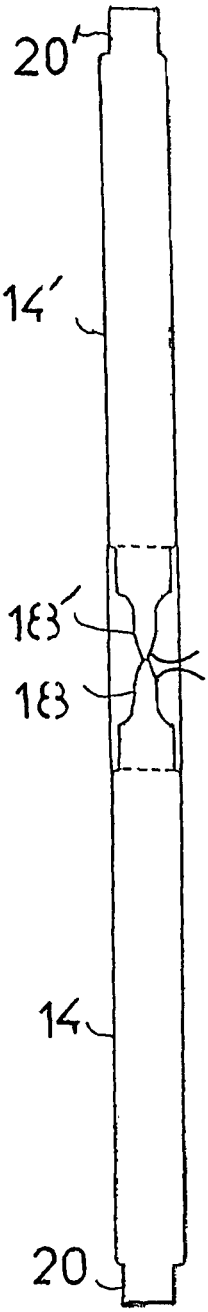
FIG. 5 is a side view partly in section of the two marker pens and docking member of FIG. 4.

In the latter location, the docking member 12 also acts as a channel from one pen nib 18 to another, as will now be described with reference to FIGS. 4 and 5.

As shown, the length of the docking member 12 is equal to approximately twice the distance from the abutment surface 15 to the tip 24 of the nib 18 of the marker pen 10.

As already mentioned, this invention sets out to provide apparatus which enables a uniform and consistent colour change to be produced in a line or succession of lines drawn by the nib of a single marker pen.

In order to provide such a consistent colour change, one open end of the docking member 12 is first positioned over the collar 16 of the marker pen 10 with the end of the docking member in engagement with the abutment surface 15. In this position the nib 18 of the marker pen 10 extends approximately half-way into the docking member 12. A second marker pen 10' containing a second dye of different colour is then inserted nib-first into the other end of the docking member 12 until the respective end of the docking member makes contact with the abutment surface 15'. Because the length of the docking member 12 is approximately twice that of the collar 16 and nib 18 combined, the tips of the nibs 18, 18' of each pen 10, 10' just touch one another when the ends of the docking member 12 abut the respective ends of the housings 14, 14' of the pens 10, 10'. The nib tip-to-nib tip contact achieved using the docking member 12 is important if a consistent colour change in use is to be achieved.

The fact that the nib tips 18, 18' touch one another allows a transfer of coloured dye from nib 18' of the second pen 10' to the nib 18 of the first pen 10 when the pens are in contact. To effect this transfer, it is preferred that the second pen 10' is held higher than the first pen 10. The docking member 12 acts to channel the dye from the second nib 18' to the first nib 18 preventing leakage of the coloured dye. The dimensions of the docking member are important to avoid damage to the nibs caused by excessive pressure being applied when the nibs come into contact and to ensure reproducible nib to nib contact for effective dye transfer.

Only a small period of time, for example five seconds, is required for sufficient dye to be transferred Other colour changes can, of course, be effected simply by appropriate selection of the original and donated colours. Thus, donated liquid may be, for example, water. In this arrangement, the line produced will essentially comprise an initially coloured line which fades until it is transparent.

In a further embodiment illustrated in *Fig.* 7, the length of the docking member 12 is greater than twice the distance from the abutment surface 15, 15' to the tip 24, 24' of the nib 18, 18' of each marker pen 10, 10'. Consequently, the nibs 18, 18' of each pen 10, 10' do not touch one another when both ends of the docking member 12 make contact with the abutment surfaces 15, 15'. In this embodiment though, one or both ends of the docking member 12 may have an internal thread 36 that receives an external thread 38 on one or both end portions of the pen housing 14. Once the docking member is engaged by the pens 10, 10', one or each pen 10, 10' is rotated to move the or each nib 18, 18' further into the docking member 12 until the nibs 18, 18' come into contact. Once the transfer of dye has taken place, the or each pen 10, 10' is simply unscrewed to disengage the threads, and the pens 10, 10' are simply pulled out of the docking member.

Instead of the removable cap 19, the end of the pen 10 may include a valve member, for example, in the form of a flexible diaphragm that is penetrable by the nib 18' of the second pen 10'.

Figure 6:
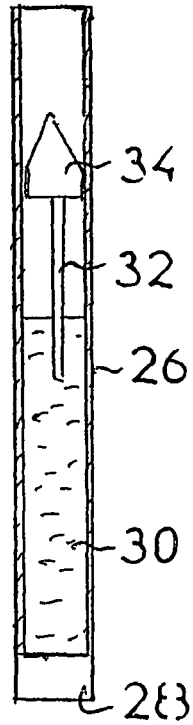
FIG. 6 is a side view in section of a marker pen and docking member in accordance with another embodiment of the invention.
Figure 7:
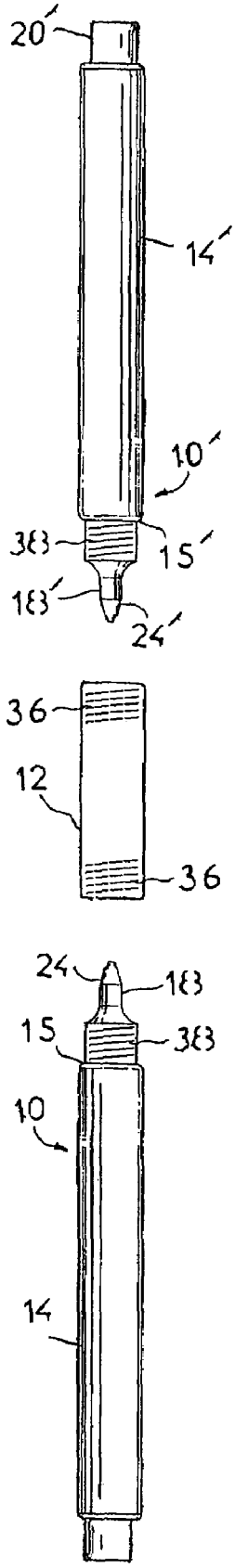
FIG. 7 is a side view of two marker pens and a docking station in accordance with a further embodiment of the invention.

Turning now to the embodiment of the invention illustrated in FIG. 6, in which like integers to those illustrated previously have the same reference numerals, it will be seen that the docking member comprises a generally tubular housing 26 closed at one end by a removable plug 28 and open at its other end to receive the nib including end of the marker pen 10. A quantity of wadding 30 in which is absorbed a liquid or dye is positioned within the housing 26. The wadding 30 defines a source of liquid or dye and is transferred by capillary action using a wick 32 to an absorbent nib 34 positioned towards the open end of the tubular housing 26. The distance between the open end of the housing 26 and the nib 34 is such that, in use, the nib of a marker pen stationed within the recessed open end of the housing 26 makes point contact with the nib 34.

It will be appreciated that the foregoing is merely exemplary of marker pens in accordance with the invention and that various modifications can readily be made thereto without departing from the true scope of the invention described as set out in the appended claims.

The invention claimed is:

1. An apparatus for enabling a marker pen to produce in a line or succession of lines a uniform and consistent color change from one color to another color, the apparatus comprising:

a source having a fluid absorbent nib containing a liquid or dye of a first color;

a marker pen having a fluid absorbent nib containing a fluid or dye of a second color; and a tubular docking member including at one end the source and its nib, and open at its other end to receive and engage the nibbed end of the marker pen, the length of the docking member being such as to enable the marker pen selectively to be placed in touching contact with the nib of the source to cause liquid or dye to pass between the nib of the source and the nib of the marker pen;

wherein a user of the marker pen is enabled to produce in a line or succession of lines a uniform and consistent color change from the first color to the second color.

2. The apparatus of claim 1, wherein the liquid is translucent.

3. The apparatus of claim 1, wherein the liquid comprises a dye.

4. The apparatus of claim 3, wherein the dye comprises a water-based ink containing coloured dyes, dispersed pigments or other colouring media.

5. The apparatus of claim 1, wherein the source of the liquid or dye comprises another marker pen.

6. The apparatus of claim 1, further comprising a means for effecting relative movement between the source and the end of the marker including the nib so as to cause the nib of the marker and the nib of the source to make contact.

7. The apparatus of claim 6, wherein the means for effecting relative movement between the source and the end of the marker including the nib comprises:

an internal thread disposed at least at one end of the docking member; and an external thread configured to be disposed at least at the end of the marker including the nib, wherein the internal thread is configured to receive the external thread such that rotation of the marker relative to the docking member imparts movement to the marker relative to the docking member so as to cause the nib of the marker and the nib of the source to make contact.

8. A colouring apparatus comprising:

a first marker having a housing including an absorbent nib containing a liquid or a dye of a first colour;

a second marker having a housing including an absorbent nib containing a liquid or dye of second colour; and a tubular docking member having a first end and a second end, wherein the housing of the first marker and the housing of the second marker are dimensioned and shaped to engage the first and second ends of the tubular docking member, and wherein the docking member is dimensioned and shaped to enable the absorbent nib of the first marker and the absorbent nib of the second marker to make contact within the docking member.

9. The colouring apparatus of claim 1, further comprising a means for effecting relative movement between the source and the end of the marker including the nib so as to cause the nib of the marker and the nib of the source to make contact.

10. The apparatus of claim 9, wherein the means for effecting relative movement between the source and the end of the marker including the nib comprises:

an internal thread disposed at least at one end of the docking member; and an external thread disposed at least at the end of the marker including the nib, wherein the internal thread is configured to receive the external thread such that rotation to the marker relative to the docking member imparts movement to the marker relative to the docking member so as to cause the nib of the marker and the nib of the source to make contact.

11. The apparatus of claim 1, wherein the source is positioned above the marker when the nibs of the source and marker are placed in contact one with the other.

* * * * *